United States Patent [19]

Mulcahy et al.

[11] 4,167,907

[45] Sep. 18, 1979

[54] RAILWAY CAR TRUCK FRICTION DAMPER ASSEMBLY

[75] Inventors: Harry W. Mulcahy, Griffith, Ind.; Horst T. Kaufhold, Chicago, Ill.

[73] Assignee: AMSTED Industries Incorporated, Chicago, Ill.

[21] Appl. No.: 844,965

[22] Filed: Oct. 25, 1977

[51] Int. Cl.[2] ..... B61F 5/06; B61F 5/12; B61F 5/24; B61F 5/52

[52] U.S. Cl. ..... 105/197 DB; 105/193; 105/207

[58] Field of Search ..... 105/197 D, 197 DB, 193, 105/207

[56] References Cited

U.S. PATENT DOCUMENTS

| | | | |
|---|---|---|---|
| 2,257,109 | 9/1941 | Davidson | 105/197 DB |
| 2,352,693 | 7/1944 | Davidson | 105/197 D |
| 2,422,638 | 6/1947 | Tucker | 105/197 D |
| 2,514,776 | 7/1950 | Mangels | 105/197 DB |
| 3,026,819 | 3/1962 | Cope | 105/197 D |

*Primary Examiner*—Francis S. Husar
*Assistant Examiner*—Howard Beltran
*Attorney, Agent, or Firm*—John L. Schmitt; Fred P. Kostka

[57] ABSTRACT

A three-piece dampener assembly provides means to depress vertical and horizontal oscillations between ends of a bolster of a railroad car truck and side frames of the truck. This assembly includes a control or friction shoe having an outer vertical engaging surface for contact with a vertical wear plate of a pocket formed in the side frame and an inner projecting triangular-shaped segment. The triangular segment is covered by a relativley low friction adapter and engages a like triangular-shaped wedge slot formed in a control or friction shoe housing. The housing further includes an inclined wear surface for engaging with a complementary inclined friction surface formed in the bolster and a bottom surface for supportive engagement with a coil spring carried in the side frame pocket below the bolster.

5 Claims, 8 Drawing Figures

FIG. 1
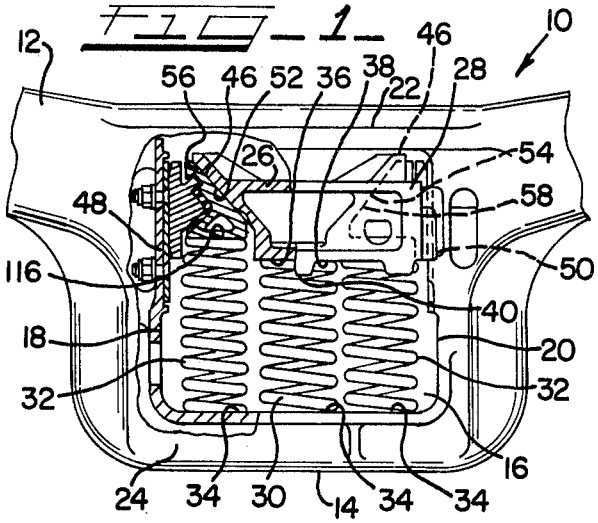
FIG. 3
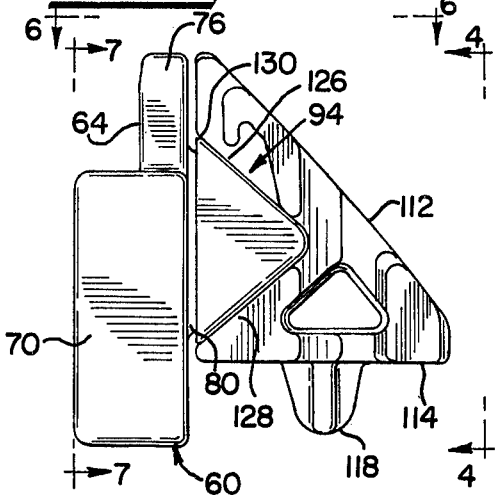
FIG. 4
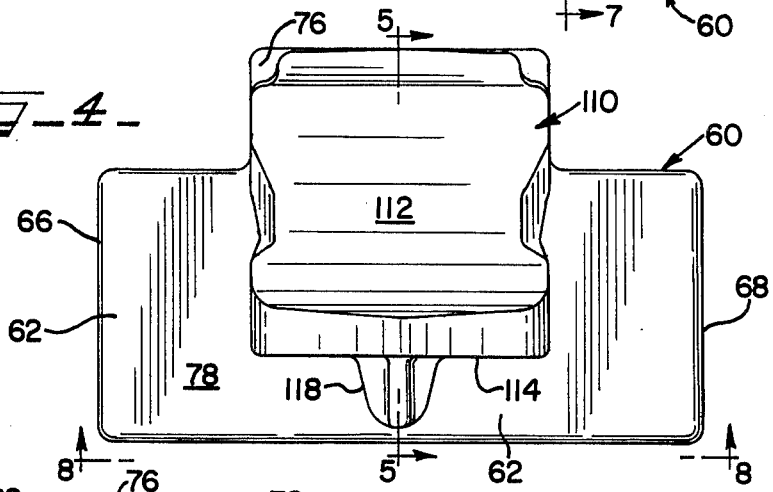
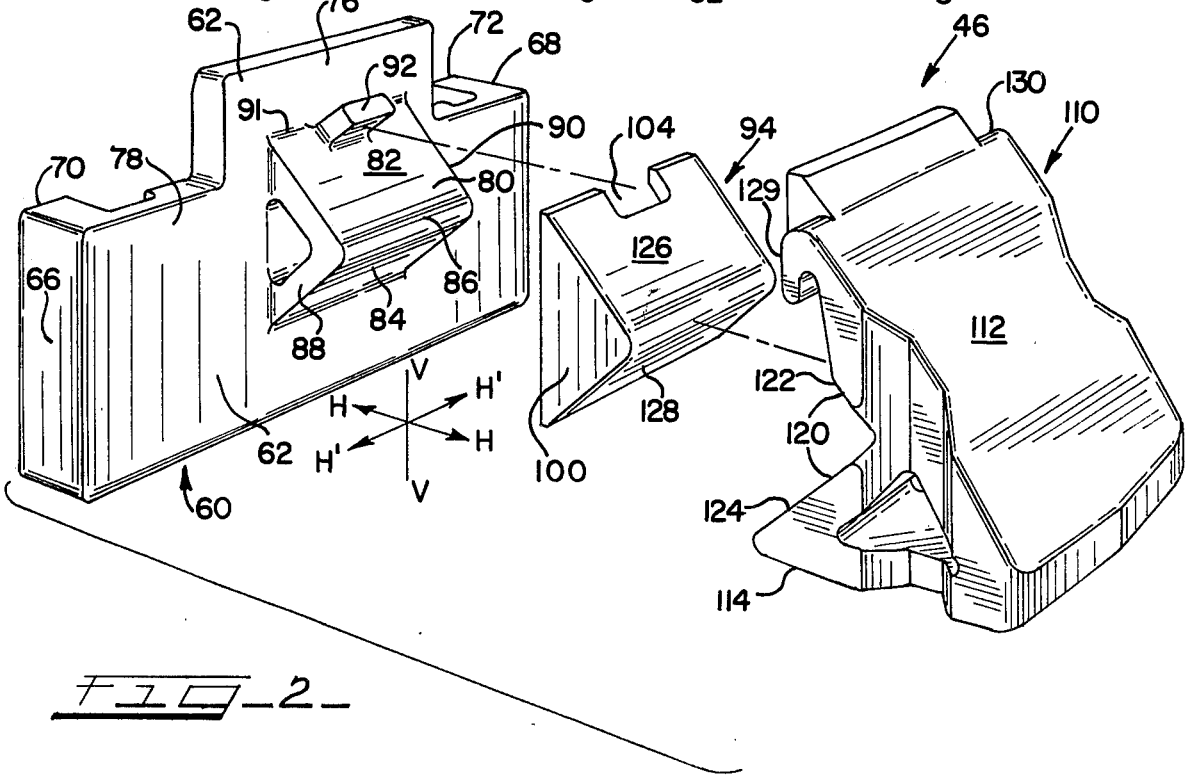
FIG. 2

RAILWAY CAR TRUCK FRICTION DAMPER ASSEMBLY

BACKGROUND OF THE INVENTION

1. Field of the Invention

This invention relates to suspension means for a railroad car truck and more particularly to a device for dampening or depressing oscillations between a bolster of the truck and side frames of the truck.

2. Prior Art

Trucks used with modern railroad cars are well known and generally include two spaced side frames which resiliently support therebetween ends of a truck bolster positioned transversely to the side frames. The resilient support of the bolster is provided, as an example, by a plurality of coil springs positioned within a opening formed in each side frame on which each end of the bolster is carried.

To dampen oscillations inherent in a coil spring type suspension, common dampening devices include a pair of friction shoes positioned on each side of a longitudinal axis of the truck bolster with each having an inclined wear surface for engaging with a like inclined friction surface formed in the bolster and a vertical wear surface for engaging with a vertical wear plate fastened to sidewalls of the side frame opening. Such an arrangement provides a three directional restraint to movements between the side frame and the bolster with substantial dampening of vertical movements and slight dampening of lateral movements.

SUMMARY OF THE INVENTION

The dampening device for use in a railroad car truck suspension system of this invention includes an outer control or friction shoe having a vertical wear surface formed between two guiding ribs for engagement with a conventional wear plate fastened to sidewalls of a railroad truck side frame opening. On an inner vertical surface of the control or friction shoe is a triangular-shaped, inwardly projecting wedge covered by an adapter made of a low friction material. The triangular wedge with its adapter cover is received with a like triangular-shaped wedge slot formed in a control or friction shoe housing. The housing further includes a bottom surface for engaging tops of coil springs carried below the housing in the pocket of the side frame and an inclined wear surface which engages with a complementary inclined friction surface formed in the end of the truck bolster.

The dampening device of the present invention provides a number of advantages over dampening devices heretofore known.

Firstly, horizontal-longitudinal movement of the bolster with respect to the side frame is only selectively restrained because the adapter provides a low friction path of movement on which the shoe housing may slide. Heretofore, such movements were highly restricted by the high friction engaging wear surfaces of the shoe with respect to the side frame wear plate and bolster pocket friction surface. Without providing means for such movement, no dampening exists.

A further important feature of the dampening device of this invention is that positive guiding means are provided on the control or friction shoe to allow vertical movement of the control shoe with respect to the side frame while at the same time preventing any misalignment which may occur during high speed, light load travel.

DESCRIPTION OF THE DRAWINGS

FIG. 1 is a fragmentary elevational view, partially in section, of a railroad car truck embodying the friction dampener assembly of the present invention.

FIG. 2 is an exploded view in perspective of the friction dampener assembly.

FIG. 3 is a side elevational view of the friction dampener assembly.

FIG. 4 is a front view of the assembly taken generally along the line 4—4 of FIG. 3.

DESCRIPTION OF THE PREFERRED EMBODIMENT

Figure 5:
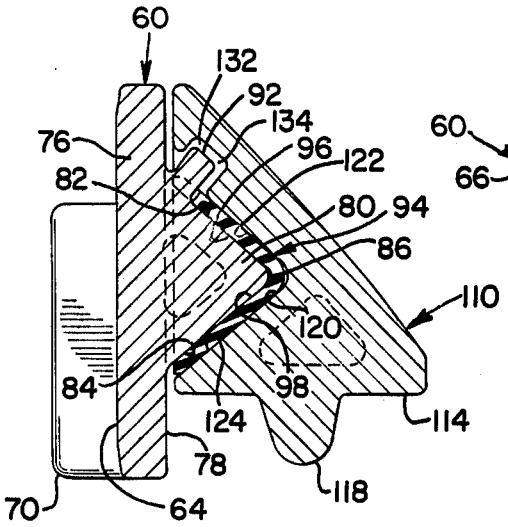
FIG. 5 is a cross-sectional view of the friction dampener assembly taken generally along the line 5—5 of FIG. 4.
Figure 6:
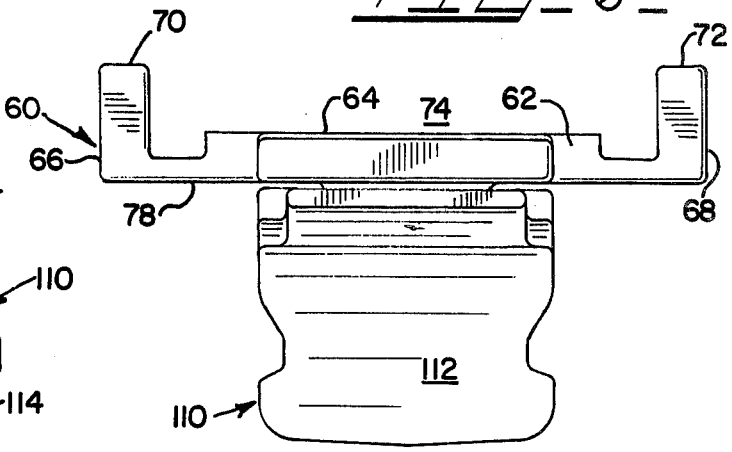
FIG. 6 is a plan view of the assembly taken generally along the line 6—6 of FIG. 3.
Figure 7:
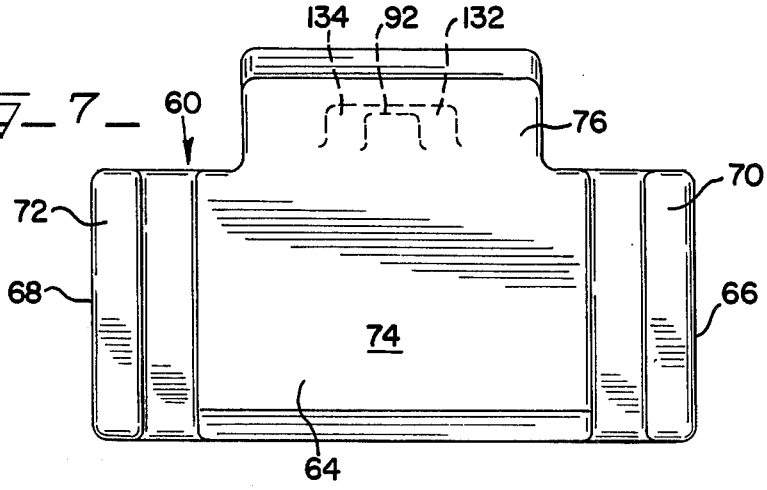
FIG. 7 is a rear elevational view of the assembly taken generally along the line 7—7 of FIG. 3.
Figure 8:
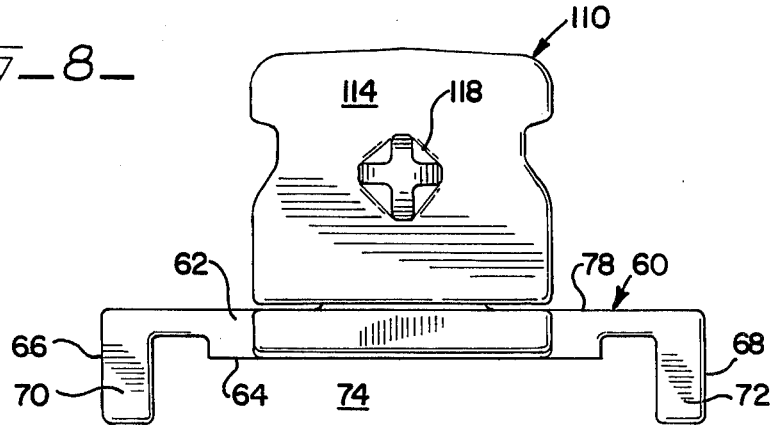
FIG. 8 is a bottom view of the assembly taken generally along the line 8—8 of FIG. 4.

A railroad truck shown in part in FIG. 1 is designated 10. The truck 10 includes a pair of spaced side frames positioned parallel to and equidistant on each side of the longitudinal axis of the truck 10 with one such side frame 12 shown in part. In a center portion 14 of the side frame 12 is a side frame window or opening 16 defined by two spaced vertical sidewalls 18 and 20, a top compression member 22 and a bottom tension member 24.

Between the spaced side frames is a transversely positioned bolster 26 having an end portion 28 located in the respective side frame openings 16 as shown in FIG. 1.

The friction dampener assembly of the present invention is incorporated into a suspension system between the side frames 12 to which wheelsets (not shown) of the car truck 10 are attached and on which a railroad car body (not shown) is supported on the bolster 26.

The suspension system comprises a plurality of coil springs including a center spring 30 located between a pair of outer springs 32. The springs 30 and 32 have the lower ends 34 thereof supported on the bottom tension member 24 of the side frame 12. The center spring 30 at its upper end 36 is in direct contact with a bottom surface 38 of the end portion 28 of the bolster 26 and held in a vertically aligning position with the longitudinal axis of the bolster 26 by downwardly extending boss 40 on the bolster 26.

To dampen vertical oscillations during travel between the bolster 26 and the side frame 12 and to cushion linear and rotational horizontal movements between the side frame 12 and the bolster 26, the suspension system includes two pair of friction dampener assemblies with one of such pair of control assemblies 46 seen in an exploded view in FIG. 2. One pair of the assemblies 46 is located in each side frame opening 16 with the assemblies symmetrically disposed on opposite sides of the longitudinal axis of the bolster 26 and positioned in an opposing manner.

On each sidewall 18, 20 of the side frame opening 16 are vertically disposed and spaced wear plates 48 and 50. Similarly, the bolster 26 at its end portion 28 has formed therein pockets 52 and 54 having inclined friction surfaces 56, 58 converging downwardly toward the longitudinal axis of the bolster 26. Only a single dampener assembly will be described in detail herein, it being understood that in actual practice the truck 10 contains four such assemblies 46 of identical structure.

The control assembly 46 includes a control shoe 60 of generally inverted T-shaped configuration. A center portion 62 of the shoe 60 is provided with a friction or wear surface 64 which engages the wear plate 48. At ends 66, 68 of the center portion 62 are spaced, outwardly projecting ribs 70 and 72 forming a guide space 74 accommodating the wear plate 48 and limiting lateral horizontal movement between the wear plate 48 and the control shoe 60 while providing a guide for vertical movement therebetween. The center portion 62 of the control shoe 60 includes an upward projecting stem or center segment 76.

On an inner vertical surface 78 of the center portion 62 of the control shoe 60 is an inwardly projecting triangular-shaped wedge 80 having top and bottom inclined surfaces 82, 84 which join to form a horizontal apex 86 and vertical sidewalls 88, 90. The wedge 80 is aligned with a vertical center line of the control shoe 60 and has a width selectively less than a width of center segment 76 of the center portion 62.

Immediately below a junction 91 of the top inclined surface 82 of the wedge 80 and the inner vertical surface 78 of the center portion 62 is an inwardly projecting tab 92 proximately at a right angle to the upper inclined surface 82 and parallel to the lower inclined surface 84.

The control assembly 46 further includes a low friction adapter 94 which is positioned over the triangular wedge 80. The low friction adapter 94 may be made from, for example, a NYLATRON material. As shown in FIGS. 2 and 5, the adapter 94 has a thin cross-sectional thickness with inner surfaces 96, 98 and inner end walls 100 dimensioned and located to fit snugly over the triangular wedge 80 and is formed with a top rectangular cutout 104 to accommodate the tab 92.

The dampener assembly 46 further includes a control shoe housing 110 formed with an inclined wear surface 112 for engagement with the friction surface 56 of the bolster pocket 52 and a flat bottom surface 114 for engagement with an upper end 116 of the outer spring 32. A downwardly extending projection 118 seats within the upper end 116 of the outer spring 32 to retain its position.

A full width triangular-shaped wedge slot 120 having an upper inclined surface 122 and a lower inclined surface 124 which engage with outer inclined surfaces 126, 128 of the adapter 94 is formed on an outer vertical wall 129 of the housing 110.

Along a top edge 130 of the upper inclined surface 122 of the triangular wedge slot 120 is a rectangular recess 132 positioned to receive the tab 92 of the control shoe 60. The recess 132 is sufficiently large to provide a clearance space 134 so as to allow limited freedom of movement of the tab 92 therein and thereby also between the control shoe 60 and the control shoe housing 110 while at the same time ensuring that a loose, assembled relationship is maintained.

The load of the railroad car body and the contents apply a downward force on the bolster 26 which is transferred by the friction surfaces 56, 58 of the bolster pockets 52, 54 to the wear surface 112 of the control shoe housing 110 in the form of horizontal and vertical force components. The horizontal load component is transferred from the control shoe housing 110 to the control shoe 60 having the vertical wear surface 64 thereof restrained by the wear plate 48 of the side frame opening 16. The vertical load component is supported and restrained by the springs 32 and a friction force developed between the wear plate 48 and the vertical wear surface 64 of the control shoe 60.

During travel of the truck 10, the load components, as denoted by arrows V—V, H—H and H'—H' as seen in FIG. 2, create horizontal and vertical oscillations which are selectively controlled and dampened by an interaction of the springs 32 with the control shoe housings 110, the vertical wear surfaces 64 of the control shoes 60 with the wear plates 48, 50 respectively of the side frame opening 16, the inclined friction surfaces 56, 58 of the bolster pocket 52, 54 with the inclined wear surfaces 112 of the control shoe housings 110 and the triangular wedges 80 of the control shoes 60 with the wedge slots 120 of the control shoe housings 110 each interfacing with the respective low friction adapter 94.

In particular, the load component H'—H' creates movement between the bolster 26 and the side frame 12 in the direction noted by the arrow H'—H' which is selectively controlled by the interaction between the adapter 94 and the wedge slot 120 of the control shoe housing 110. Additionally, occasional movement in the direction denoted by arrow H—H caused by the load component H—H is selectively controlled by the interaction of the upper and lower wedge slot surfaces 122 and 124 and the outer surfaces 126 and 128 of the adapter 94.

While various modifications may be suggested by those versed in the art, it should be understood that we wish to embody within the scope of the patent warranted hereon, all such modifications as reasonably and properly come within the scope of our contribution to the art.

What is claimed is:

1. An oscillation dampening assembly for dampening oscillations between a bolster resiliently supported in an opening provided in a railroad truck side frame, said oscillation dampening assembly comprising, a control shoe having a friction surface engageable with said side frame, a control shoe housing having an inclined friction surface engageable with said bolster, complementary friction surface means on said control shoe and said control shoe housing permitting relative lateral movement in a plane substantially normal to a plane of said control shoe friction surface, and friction control means interposed between said complementary control shoe friction surfaces and said complementary control shoe housing friction surfaces so that frictional restraint between said complementary friction surfaces is less than frictional restraint between said side frames and said control shoe.

2. A dampening device for a railroad car truck suspension system to selectively dampen movements between spaced side frames of said truck and an elongated truck bolster positioned transversely between said side frames and having ends carried in openings formed in said side frames respectively, said dampening device comprising, a control shoe having a center portion with an outer vertical wear surface prepared for engagement with a vertical sidewall of said side frame opening, outwardly extending vertical ribs formed at ends of said center portion to provide a guide means for vertical movements between said sidewalls of said side frame opening and said control shoe, and an inner vertical surface having formed thereon an inner projecting wedge means, an adapter of a thin, selective friction material formed to mate with and cover said wedge, and a control shoe housing having an inner inclined wear surface prepared for engaging with an inclined friction surface formed in said end of said bolster, a bottom surface prepared for engaging with an upper end of a spring means carried in said side frame pocket, and a wedge slot means formed on an outer surface of said control shoe to mate with an outer surface of said adapter, said device disposed in said side frame opening and carried therein by said spring means supporting said control shoe and with said adapter covering said wedge of said control shoe and in contact with said wedge slot of said control shoe housing, wherein vertical movements and horizontal movements between said bolster and said side frame are effectively dampened upon relative movement by interaction of said engaging surfaces of said side frame pockets, said control shoe, said adapter, said control shoe housing and said bolster.

3. A dampening device according to claim 2 and further characterized by, said wedge means of said control shoe having a triangular configuration with an upper inclined surface joining a lower inclined surface to form a horizontal apex, said wedge slot means of said control shoe housing having a triangular configuration with an upper and lower inclined surface joining to form a horizontal apex, a holding tab formed at a top of said upper inclined surface of said wedge, and a recess formed in said control shoe housing at a top of said upper inclined surface of said wedge slot, said recess positioned to receive therein said tab of said control shoe with a loose fit, wherein horizontal movements between said control shoe and said control shoe housing are controlled by said adapter selectively engaging with said wedge slot means of said control shoe housing.

4. A dampening device as defined by claim 3 and further characterized by, said vertical wear surface of said control shoe having a selective height dimension, said control shoe housing having a selective height dimension less than said control shoe wear surface height, a plane of said inclined wear surface of said control shoe housing forming a hypotenuse of a triangle further defined by a plane of said bottom surface of said control shoe housing and said plane of said vertical wear surface of said control shoe, said wedge positioned to proximately align with a center point of said control shoe vertical wear surface with a plane of said horizontal wedge apex intersecting said hypotenuse at a point proximately below the center point of said height of said control shoe housing.

5. A dampener device for use with a suspension system of a railroad car truck including two spaced side frames each carrying an end of a transversely positioned bolster in a opening formed in each said side frame, said device comprising, control shoe means including, a vertical wear surface formed on an outer surface of said control shoe means for frictional regulated engagement with a vertical side of said side frame opening, guide means formed at ends of said control shoe means to control and limit said engagement between sidewalls of said side frame opening and said vertical wear surface of said control shoe to movement in a vertical direction, wedging means formed on an inner surface of said control shoe means to provide a horizontal support, and tab means formed on said inner surface of said control shoe means above said wedging means to provide a support, adapter means disposed over said wedge means to provide a selective friction engaging surface, and control shoe housing means including, an inclined wear surface formed on an inner side of said control shoe housing means for frictional regulated engagement with a like inclined surface in said bolster end, wedging slot means formed in an outer surface of said control shoe housing means to receive therein said wedging means of said control shoe means for regulating therebetween horizontal movements and dampening said horizontal movements comprising oscillations, and slot means formed on said inner side of said control shoe housing means above said wedging slot means to receive therein said tab means of said control shoe means in a loose relationship to allow movement between said control shoe means and said control shoe housing means but restrict disassembly of such, wherein said dampening device acts to control the magnitude of vertical oscillations and horizontal oscillations.

* * * * *